US009506719B2

(12) United States Patent
Makowski

(10) Patent No.: US 9,506,719 B2
(45) Date of Patent: Nov. 29, 2016

(54) VELOCITY ALIGNED THROWABLE OBJECT

(71) Applicant: Gary G. Makowski, Huntsville, AL (US)

(72) Inventor: Gary G. Makowski, Huntsville, AL (US)

( * ) Notice: Subject to any disclaimer, the term of this patent is extended or adjusted under 35 U.S.C. 154(b) by 445 days.

(21) Appl. No.: 13/827,672

(22) Filed: Mar. 14, 2013

(65) Prior Publication Data

US 2014/0259682 A1 Sep. 18, 2014

(51) Int. Cl.
*F41B 15/00* (2006.01)

(52) U.S. Cl.
CPC ..... *F41B 15/00* (2013.01)

(58) Field of Classification Search
CPC ..... B26B 11/00; B67B 7/24; B25G 1/102; F41B 15/00
USPC ..... 30/123, 1, 340, 342, 123.3, 142, 165, 30/125, 514, 517, 343, 344; 473/578–586
See application file for complete search history.

(56) References Cited

U.S. PATENT DOCUMENTS 983,736 A * 2/1911 Maconochie ..... A47G 21/02 29/525
2,168,365 A 8/1939 Stacy-Judd
3,198,526 A 8/1965 Smith et al.
3,772,781 A 11/1973 Newman
4,765,628 A 8/1988 Jensen
D301,048 S 5/1989 Hollinshead
5,197,745 A 3/1993 Whiteley
5,344,158 A 9/1994 Gridley
5,642,565 A 7/1997 Riestra
5,822,867 A * 10/1998 Sakai ..... B26B 1/10 30/155
6,010,419 A 1/2000 Rappaport et al.
6,108,911 A 8/2000 Hoch
2010/0083507 A1* 4/2010 Glesser ..... B26B 1/048 30/161

OTHER PUBLICATIONS ( Windy City Novelties, Inc., LED Sword—Light Up Toy Sword!—LED Sword, Apr. 28, 2011, https://www.youtube.com/watch?v=Pg3Xb7UesBQ).*
(Cold Steel's sword inventory is missing a ninjato!, Jan. 8, 2010, http://coldsteelforums.com/tm.aspx?m=74990&mpage=1&tree=true).*
(Custom-Made Sparring Grade swords and Knives, Aug. 16, 2007, https://web.archive.org/web/20071016051934/http://www.stick-man-escrima.com/Products/Custom_Swords.htm).*
Mermagen, William H., High Spin Compound Air Bearing, United States Statutory Invention Registration H174, Dec. 2, 1986.

* cited by examiner

*Primary Examiner* — Sean Michalski
*Assistant Examiner* — Liang Dong
(74) *Attorney, Agent, or Firm* — Ann I. Dennen

(57) ABSTRACT

A VATO comprises a blade, a handle, a stabilizing assembly, and a spherical weight. In a preferred embodiment, the spherical weight makes up a significant portion of the overall weight of the VATO. The spherical weight is positioned between the blade and the handle, and the stabilizing assembly is attached to a rear portion of the handle. When the VATO is thrown, a velocity vector is established in the direction of the trajectory of the VATO. The stabilizing assembly produces aerodynamic drag which assists in keeping the blade oriented in a forward position with respect to the trajectory of the VATO. The spherical weight is permitted to freely rotate thereby enabling the blade, the handle and the stabilizing assembly to independently rotate into alignment with the trajectory of the VATO such that the blade is in a forward position as the VATO strikes a target.

16 Claims, 5 Drawing Sheets

VELOCITY ALIGNED THROWABLE OBJECT

BACKGROUND OF THE INVENTION

This invention generally relates to weapons. In particular, the present invention relates to knives and axes. More particularly, the present invention relates to knives and axes which may be thrown in an unorthodox method similar to that of throwing a dart or a spear.

Conventional knives and axes are thrown at a target by rotating the knife or axe end over end through the air such that the blade is facing the target at the point of contact. Great skill is required to consistently hit the target with the blade due to the difficulty of achieving the proper velocity and the proper number of rotations in order to ensure that the blade penetrates the target from a given distance. However, users with little skill or experience have a difficult time consistently hitting the target with the blade such that the blade remains in the target. Such users frequently hit the target with the side of the blade or with the handle of the knife or axe due to the inability of the conventional knives and axes to stabilize themselves in flight with the blade facing the target.

It is, therefore, desirable to provide knife or axe which may be thrown like a dart or spear and which automatically stabilizes itself in flight such that the blade is oriented toward the target.

SUMMARY OF THE INVENTION

The present invention recognizes and addresses various of the foregoing limitations and drawbacks, and others, concerning throwable weapons. Therefore, the present invention is directed to a velocity aligned throwable object (VATO).

It is, therefore, a principle object of the subject invention to provide a VATO. More particularly, it is an object of the present invention to provide a VATO having a blade, a spherical weight, a handle, and a rear stabilizing assembly. In such context, it is still a more particular object of the present invention to provide a VATO having a spherical weight comprising a significant portion of the weight of the VATO wherein the spherical weight is allowed to freely rotate in order to maintain proper orientation of the VATO.

Additional objects and advantages of the invention are set forth in, or will be apparent to those of ordinary skill in the art from, the detailed description as follows. Also, it should be further appreciated that modifications and variations to the specifically illustrated and discussed features and materials hereof may be practiced in various embodiments and uses of this invention without departing from the spirit and scope thereof, by virtue of present reference thereto. Such variations may include, but are not limited to, substitutions of the equivalent means, features, and materials for those shown or discussed, and the functional or positional reversal of various parts, features, or the like.

Still further, it is to be understood that different embodiments, as well as different presently preferred embodiments, of this invention, may include various combinations or configurations of presently disclosed features, elements, or their equivalents (including combinations of features or configurations thereof not expressly shown in the figures or stated in the detailed description).

These and other features, aspects and advantages of the present invention will become better understood with reference to the following descriptions and appended claims. The accompanying drawings, which are incorporated in and constitute a part of this specification, illustrate an embodiment of the invention and, together with the descriptions, serve to explain the principles of the invention.

In one exemplary embodiment, there may be provided a VATO comprising a blade, a handle, a stabilizing assembly, and a spherical weight. In a preferred embodiment, the spherical weight makes up a significant portion of the overall weight of the VATO. The spherical weight is positioned between the blade and the handle, and the stabilizing assembly is attached to a rear portion of the handle. When the VATO is thrown, a velocity vector is established in the direction of the trajectory of the VATO. The stabilizing assembly produces aerodynamic drag which assists in keeping the blade oriented in a forward position with respect to the trajectory of the VATO. The spherical weight is permitted to freely rotate thereby enabling the blade, the handle and the stabilizing assembly to independently rotate into alignment with the trajectory of the VATO such that the blade is in a forward position as the VATO strikes a target.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure.

DETAILED DESCRIPTION

Figure 1:
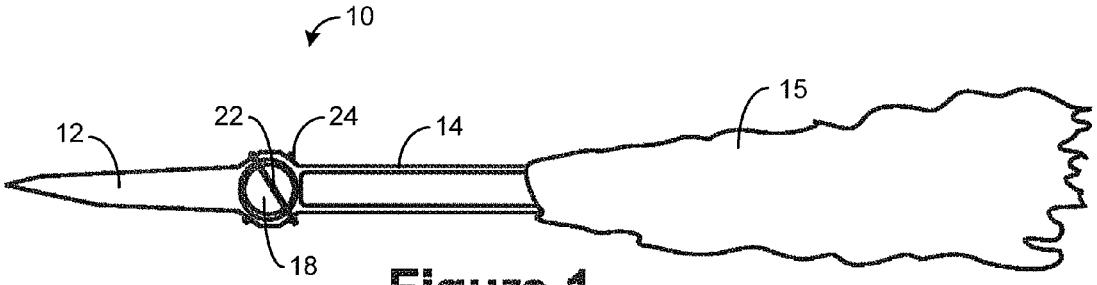
FIG. 1 depicts a side view of an exemplary embodiment of a VATO.

FIG. 1 depicts a side view of an exemplary embodiment of a velocity aligned throwable object (VATO) 10. The VATO 10 comprises a blade 12, a handle 14, a rear stabilizing assembly 15, and a spherical weight 18. In one embodiment, the blade 12 and handle 14 are formed from one solid piece of rigid material, such as, for example steel. However, in other embodiments, the blade 12 and the handle 14 may be formed from multiple pieces of material. The handle 14 and blade 12 may be used in the same way a conventional knife is used for uses such as cutting, carving or slicing. As shown by FIG. 1, the VATO 10 has an opening 20 for receiving the spherical weight 18. In one embodiment, the opening 20 is positioned between the blade 12 and the handle 14, although other locations for the opening 20 are possible in other embodiments. The spherical weight 18 is maintained within the opening 20 by one or more retaining pieces 22. The retaining pieces 22 may comprise flexible metal or other similar materials which may be easily bent yet rigid enough to support the spherical weight 18.

In one embodiment, the retaining pieces 22 are secured to the VATO 10 by looping the pieces 22 through one or more eyelets 24 which are positioned on the VATO 10. However, other means for securing the retaining pieces 22 to the VATO 10 are possible in other embodiments. The rear stabilizing assembly 15 is attached to a rear portion of the handle 14. When in a deployed position, as shown by FIG. 1, the rear stabilizing assembly 15 stabilizes the blade 12 and handle 14 by producing aerodynamic drag such that the blade 12 remains oriented in a forward position relative to the trajectory of the VATO 10. Thus, when the VATO 10 is thrown, the blade 12, handle 14 and stabilizing assembly 15 may rotate independently from the spherical weight 18 based on aerodynamic drag thereby ensuring that the blade 12 is in a forward position relative to the direction the VATO 10 is traveling. Even if the VATO 10 is thrown such that the blade 12 is initially in a rear position relative to the trajectory of the VATO 10, the stabilizing assembly 15 will correct the orientation of the blade 12 such that the blade 12 is adjusted to the forward position. In one embodiment, the rear stabilizing assembly 15 comprises cloth or other flexible material for providing aerodynamic stability. However, the rear stabilizing assembly 15 may comprise collapsible fins, rudders, arrow fletchings, wings or the handle 14 itself in other embodiments.

The spherical weight 18 makes up a substantial portion of the overall weight of the VATO 10 in order to allow rapid alignment of the other components of the VATO 10. The spherical weight 18 also rotates within the opening 20 independently from the other components of the VATO 10. Thus, the trajectory of the spherical weight 18 dictates the trajectory of the VATO 10 as well as the orientation of the blade 12 as it approaches a target (not shown). Accordingly, the blade 12 is oriented towards the target upon impact.

Figure 2:
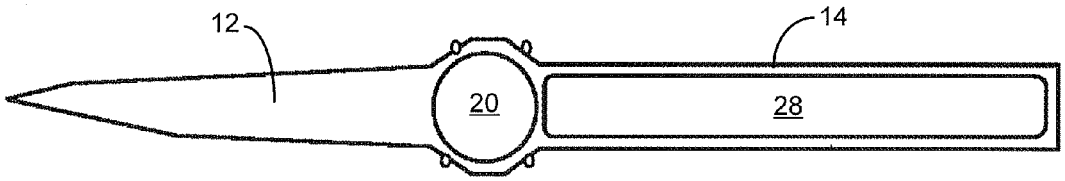
FIG. 2 depicts a side view of the blade and the handle of the VATO of FIG. 1.

FIG. 2 depicts a side view of an exemplary embodiment of the blade 12 and handle 14 of the VATO 10 FIG. 1. As set forth above, in one embodiment, the blade 12 and handle 14 are formed from one solid piece of material, such as, for example, steel. The blade 12 is formed into a sharp point for piercing a target (not shown) and may have at least one sharp edge for cutting, carving, and/or slicing. The handle 14 shown by FIG. 2 is generally rectangular in shape, although other shapes are possible in other embodiments. In one embodiment, the handle 14 has a large opening 28 extending from side to side through the handle 14 in order to reduce the weight of the handle 14 such that the spherical weight 18 (FIG. 1) constitutes a significant portion of the overall weight of the VATO 10. The blade 12 and the handle 14 may have different sizes and shapes in other embodiments.

The opening 20 is located between the blade 12 and the handle 14 and extends from side to side through the VATO 10. The opening 20 receives the spherical weight 18. The eyelets 24 are positioned in relatively close proximity to the opening 20 in order to receive the retaining pieces 22 (FIG. 1) and enclose the spherical weight 18 within the opening 20. While four eyelets 24 are shown in FIG. 2, other numbers of eyelets 24 are possible in other embodiments.

Figure 3:
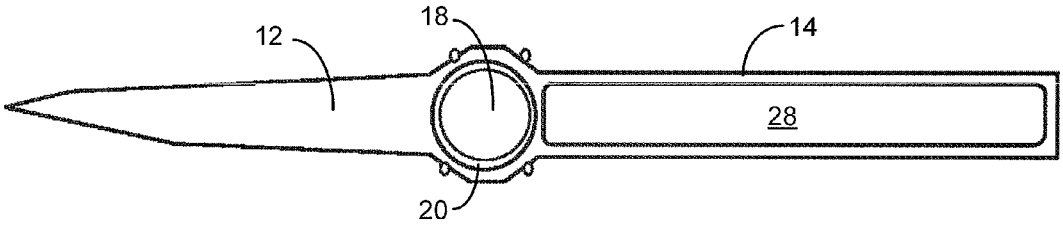
FIG. 3 depicts a side view of the VATO of FIG. 1 with the stabilizing assembly and the retaining piece removed.

FIG. 3 depicts a side view of the VATO 10 of FIG. 1 with the stabilizing assembly 15 and the retaining piece 22 removed. As shown by FIG. 3, the spherical weight 18 is positioned within the opening 20. The spherical weight 18 may comprise any weighted object that is generally spherical in shape, such as, for example, a ball bearing or a spherical container filled with liquid. In an alternative embodiment, the spherical weight 18 may be located within a cylindrical container (not shown) positioned within the opening 20. In such embodiment, the spherical weight 18 is loose within the cylindrical container in order to allow the weight 18 to move independently from the other components of the VATO 10.

The circumference of the opening 20 is larger than the circumference of the spherical weight 18 such that the weight 18 may freely spin and rotate within the opening 20 independently from the other components of the VATO 10. Thus, as the VATO 10 travels through the air, the other components of the VATO 10 independently align themselves with the trajectory of the spherical weight 18 by pivoting about the spherical weight 18. Accordingly, the blade 12 remains in a forward position with respect to the trajectory of the VATO 10 while in flight.

Figure 4:
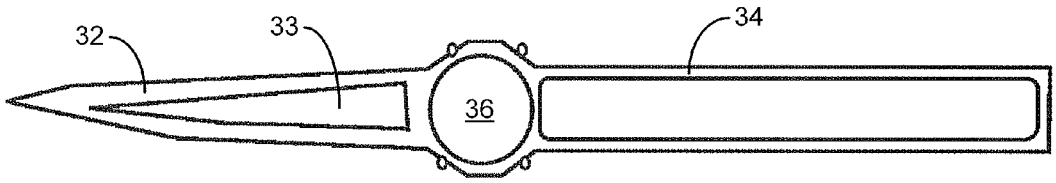
FIG. 4 depicts a side view of an exemplary embodiment of the VATO of FIG. 1 having a modified blade.

FIG. 4 depicts a side view of another exemplary embodiment of the VATO 10 of FIG. 1 with the stabilizing assembly 15 and the retaining piece 22 removed. The handle 34 and the opening 36 of FIG. 4 are identical to the handle 14 and the opening 20 of FIG. 3, respectively. However, the VATO 10 of FIG. 4 comprises a blade 32 having an opening 33 extending from side to side through the blade 32. The opening 33 may be any size or shape. The opening 33 decreases the weight of the blade 32 thereby decreasing the overall weight of the VATO 10. Such decreased weight in the blade 32 enhances the aerodynamic stability of the VATO 10 by removing weight from the front of the VATO 10 while it is in flight and allowing the blade 32 and the handle 34 to easily adjust to the trajectory of the VATO 10. As the weight of the blade 32 and the handle 34 decreases with respect to the weight of the spherical weight 18 (FIG. 1), the ability of the blade 32 and the handle 34 to easily align with the trajectory of the spherical weight 18 increases. Therefore, reducing the weight of the blade 32 and the handle 34 with respect to the weight of the spherical weight 18 is desirable.

Figure 5:
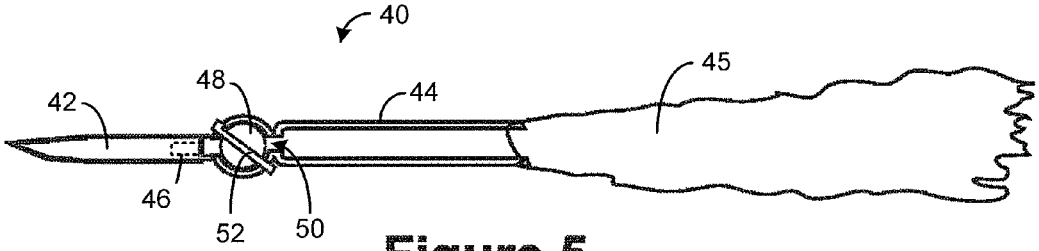
FIG. 5 depicts a side view of an exemplary embodiment of a VATO according to another aspect of the present disclosure.

FIG. 5 depicts a side view of another exemplary embodiment of a VATO 40. The VATO 40 comprises a removable blade 42, a wire frame handle 44, a stabilizing assembly 45, and a spherical weight 48. The blade 42 and the handle 44 are formed from separate pieces of material. The blade 42 is coupled to a forward end of the handle 44 and the stabilizing assembly 45 is coupled to a rear end of the handle 44. In one embodiment, the blade 42 comprises steel, although other materials are possible in other embodiments. The handle 44 comprises at least one wire formed into a generally rectangular shape having an opening 50 for receiving the spherical weight 48. The handle 44 may comprise steel or any other suitable material.

The spherical weight 48 is retained within the opening 50 by one or more retaining pieces 52. The retaining pieces 52, like the retaining pieces 22 set forth above with respect to FIG. 1, are made from flexible metal or other similar material which may be easily formed yet strong enough to support the spherical weight 48. In one embodiment, the retaining pieces 52 are bent around portions of the handle 44 on opposing sides of the opening 50 in order to retain the spherical weight 48 within the opening 50. However, other means for attaching the retaining pieces 52 to the handle 44 are possible in other embodiments.

The stabilizing assembly 45 produces aerodynamic drag thereby allowing components of the VATO 40 to rotate about the spherical weight 48 and become aligned such that the blade 42 is in a forward position with respect to the VATO 40 during flight. If the blade 42 is not in a forward position with respect to the trajectory of the spherical weight 48 during flight, the stabilizing assembly 45 produces aerodynamic drag and aligns itself in a rearward position with respect to the trajectory. Accordingly, the blade 42 is also adjusted such that the blade 42 is in a forward position with respect to the trajectory of the VATO 40. If the trajectory of the spherical weight 48 changes during flight, such as, for example, traveling downward due to the force of gravity, the stabilizing assembly 45 realigns itself such that the assembly 45 is in a rearward position and the blade 42 is in a forward position with respect to the downward trajectory of the spherical weight 48. Thus, the blade 42 remains in a forward position and the stabilizing assembly 45 remains in a rearward position with respect to the trajectory of the VATO 40 during flight.

Figure 6:
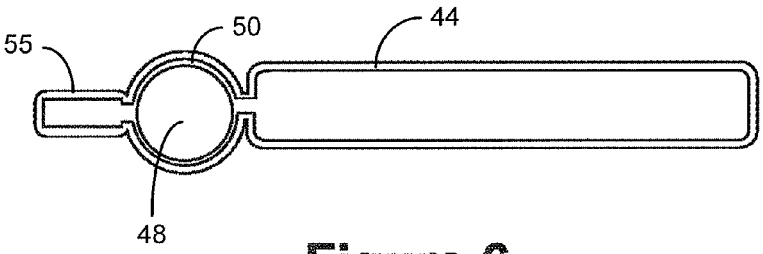
FIG. 6 depicts a side view of the handle and the spherical weight of the VATO of FIG. 5.

FIG. 6 depicts a side view of the handle 44 and the spherical weight 48 of the VATO 40 of FIG. 5. As set forth above, the handle 44 comprises wire, such as, for example, steel wire. In one embodiment, the handle 44 is formed from one continuous piece of wire, although a plurality of wires may be used to form the handle 44 in other embodiments. The handle 44 forms the opening 50, and the handle 44 has an integrated coupling piece 55 extending from a forward end of the handle 44. The opening 50 receives the spherical weight 48 and the coupling piece 55 engages with the blade 42 (FIG. 5). As shown in FIG. 6, the opening 50 is positioned at a generally central position with respect to the handle 44. Thus, the spherical weight 48 is positioned between the blade 42 and a majority of the handle 44. In one embodiment, the coupling piece 55 may be inserted to a slot 46 at the base of the blade 42 in order to secure the blade 42 to the coupling piece 55, although other methods of securing the blade 42 to the piece 55 are possible in other embodiments. The stabilizing assembly 45 is coupled to a rear portion of the handle 44 when the VATO 40 is fully assembled.

Figure 7:
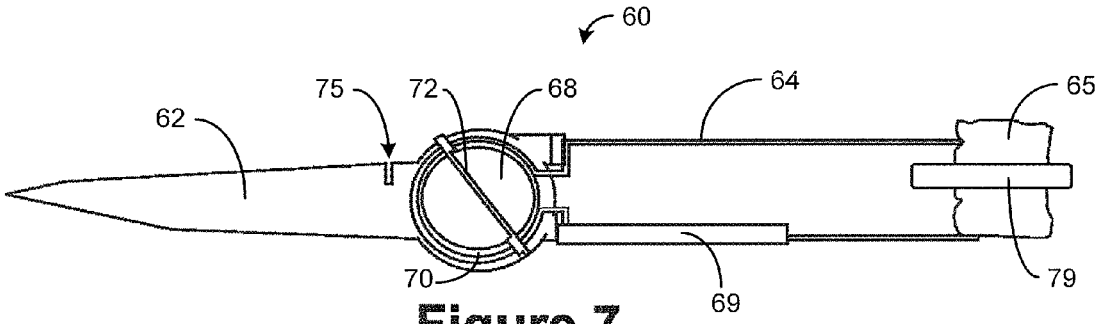
FIG. 7 depicts a side view of an exemplary embodiment of a VATO according to another aspect of the present disclosure in an open position.

FIG. 7 depicts another exemplary embodiment of a foldable VATO 60 in an open position. The VATO 60 comprises a blade assembly 62, a handle assembly 64, a stabilizing assembly 65, a spherical weight 68, and a locking device 69. The blade assembly 62 comprises a blade 63. The blade assembly 62 has a circular opening 70 for receiving the spherical weight 68, and the weight 68 is retained within the opening 70 with one or more retaining pieces 72. In one embodiment, the retaining pieces 72 are secured to the blade assembly 62 by wrapping opposing ends of the pieces 72 around portions of the assembly 62 on opposing sides of the opening 70. Other means for securing the retaining pieces 72 are possible in other embodiments. The blade assembly 62 has one or more slots 75 for receiving the locking device 69 and maintaining the blade assembly 62 in an open position or a closed position. The blade assembly 62 and the handle assembly 64 are coupled with a hinge 67 that allows the blade assembly 62 and the handle assembly to be folded toward one another in a closed position.

In one embodiment, the handle assembly 64 may be formed from one or more flexible metal wires, discussed in more detail hereafter. However, the handle assembly 64 may be formed from at least one piece of solid material, such as, for example, steel in other embodiments. In one embodiment, the handle assembly 64 comprises a wire mesh cover (not shown). The wire mesh cover protects a user's hand and/or other body parts from injury when the blade assembly 12 is in a closed position, as will be discussed in more detail below. However, other types of covers are possible in other embodiments. A portion of the handle assembly 64 extends around the spherical weight 68 and pivotally engages with the blade assembly 62 in order to allow the blade assembly 62 to rotate about the spherical weight 68.

The stabilizing assembly 65 is attached to a rear portion of the handle assembly 64. The stabilizing assembly 65 shown in FIG. 7 is in a stowed position and is held in such position with a clip 79. The clip 79 prevents the stabilizing assembly 65 from hanging freely from the handle assembly 64 and interfering with handheld use of the VATO 60. When a user desires to throw the VATO 60, the user ensures that the blade assembly 62 is in an open position and removes the clip 79 in order to transition the stabilizing assembly 65 to a deployed position. The stabilizing assembly 65 then adjusts the position of the blade assembly 62 with respect to the trajectory of the VATO 60 while in flight, as set forth above. Although FIG. 7 depicts the clip 79 for holding the stabilizing assembly 65 in the stowed position, other means for holding the assembly 65 in such position are possible in other embodiments.

Figure 8:
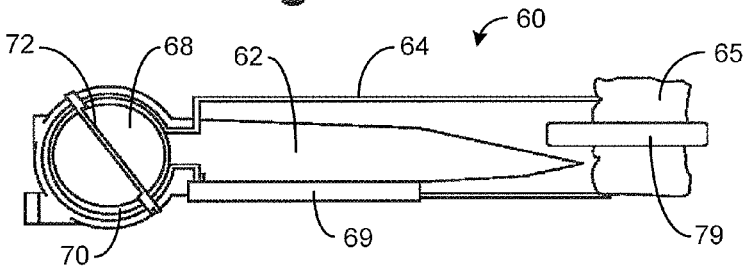
FIG. 8 depicts a side view of the VATO of FIG. 7 in a closed position.

FIG. 8 depicts the VATO 60 of FIG. 7 with the blade assembly 62 in a closed position. When the blade assembly 62 is not in use, the blade assembly 62 may be rotated to a closed position such that the blade 63 is positioned within the handle assembly 64. Such positioning of the blade 63 prevents a user from suffering an injury by preventing contact with the blade. The locking device 69 engages with the blade assembly 62 and locks the blade assembly 62 in a closed position in order to prevent the blade 63 from rotating out of the handle assembly 64. Thus, the VATO 60 may be safely handled or stored.

Figure 9:
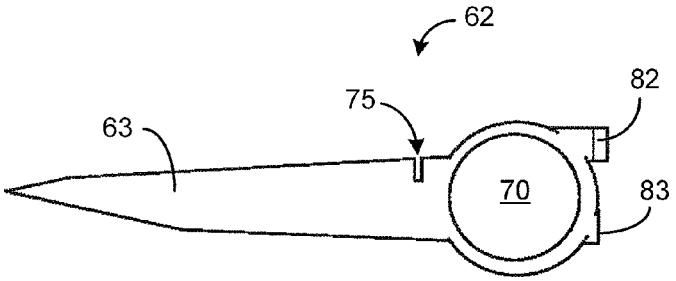
FIG. 9 depicts a side view of the blade assembly of the VATO of FIG. 7.

FIG. 9 depicts a side view of an exemplary embodiment of the blade assembly 62 of FIG. 7. The blade assembly 62 comprises the blade 63, an upper blade stop 82, and a lower blade stop 83. The blade assembly 62 has the circular opening 70 for receiving the spherical weight 78 (FIG. 7), and the blade 63 has at least one slot 75 for receiving the locking device 69 when the blade assembly 62 is in a closed position. The upper blade stop 82 extends in a generally perpendicular direction to the remainder of the blade assembly 62, and the upper blade stop 82 abuts a portion of the handle assembly 64 (FIG. 7) in order to prevent further rotation of the blade assembly 62 when the assembly 62 is in the open position. The lower blade stop 83 is a substantially flat piece which extends from the handle assembly 64 and abuts the locking device 69 in order to lock the blade assembly 62 in an open position and prevent the blade assembly 62 from rotating back to a closed position. Although the VATO 60 of FIG. 9 depicts the upper blade stop 82 and the lower blade stop 83, other means for locking the blade assembly 62 in open and closed positions are possible in other embodiments.

Figure 10:
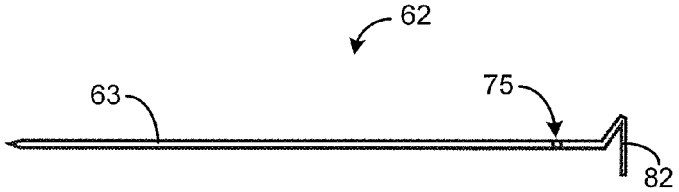
FIG. 10 depicts a top view of the blade assembly of the VATO of FIG. 7.

FIG. 10 depicts a top view of the blade assembly 62 of FIG. 7. The upper blade stop 82 is oriented in a generally perpendicular position with respect to the blade 63. Such orientation allows the upper blade stop 82 to rest against a portion of the handle assembly 64 and to prevent further rotation of the blade assembly 62 when the blade assembly 62 is in the open position. The slot 75 extends down into the blade 63 from the top of the blade 63 in order to allow the locking device 69 to lock the blade assembly 62 in the open position.

Figure 11:
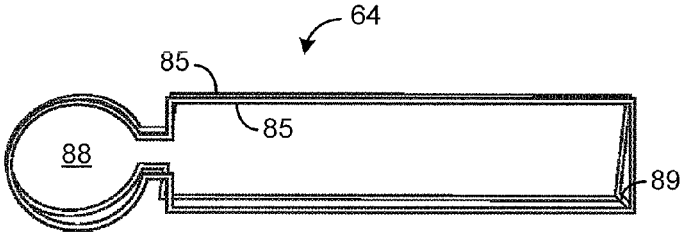
FIG. 11 depicts a perspective view of the handle assembly of the VATO of FIG. 7.

FIG. 11 depicts a perspective view of the handle assembly 64 of FIG. 7. The handle assembly 64 comprises at least one wire frame member 85 formed to define an opening 88 at a forward end of the handle assembly 64 for receiving the spherical weight 68 (FIG. 7). In one embodiment, the handle assembly 64 comprises two steel wire frame members 85, although other numbers and types of members 85 are possible in other embodiments. The blade assembly 62 (FIG. 7) engages with the forward end of the handle assembly 64 such that the opening 70 aligns with the opening 88 and the blade assembly 62 may rotate about the spherical weight 68. In one embodiment, a rear end of the blade assembly 62 is positioned between forward ends of opposing wire frame members 85 of the handle assembly 64. In such embodiment, the blade assembly 62 may be rotated about the spherical weight 68 such that the blade 63 (FIG. 7) is positioned between the wire frame members 85 when the blade assembly 62 is in the closed position. Other means for engaging the blade assembly 62 with the handle assembly 64 are possible in other embodiments.

In one embodiment, the handle assembly 64 further comprises a cross brace 89 for coupling rear ends of the wire frame members 85 to one another. However, in another embodiment, the handle assembly 64 may be formed from one contiguous wire frame member 85 having two sides. Other handle assembly configurations are possible in other embodiments.

Figure 12:
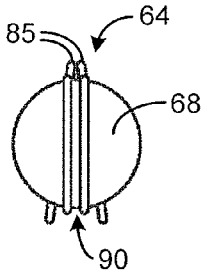
FIG. 12 depicts a front view of the spherical weight and the handle assembly of FIG. 7.

FIG. 12 depicts a front view of the spherical weight 68 of FIG. 7 positioned within the openings 88 (not shown in FIG. 12) of the wire frame members 85 of FIG. 11. As shown in FIG. 12, the wire frame members 85 of the handle assembly 64 meet at their tops and extend downwardly away from one another such that the wire frame members 85 are separated by a gap 90. The spherical weight 68 is positioned within the openings 88 of the wire frame members 85. The blade assembly 62 (FIG. 7) is positioned within the gap 90 and pivots about the spherical weight 68 in order to allow the blade assembly 62 to transition between the open and closed positions.

Figure 13:
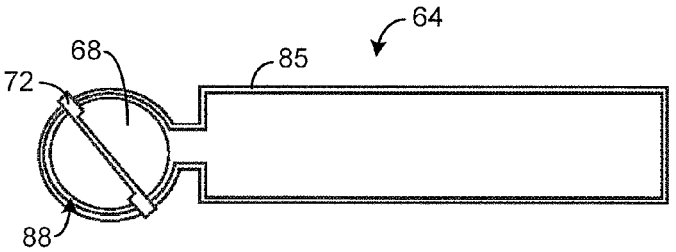
FIG. 13 depicts a side view of the spherical weight of FIG. 7 retained within the handle assembly by the retaining piece.

FIG. 13 depicts a side view of the spherical weight 68 retained within the opening 88 of the wire frame member 85 with a retaining piece 72, as is depicted by FIG. 7. The wire frame member 85 of the handle assembly 64 may be formed into any desirable shape suitable for gripping. The wire frame member 85 has a circular front portion having the opening 88 for receiving the spherical weight 68. The diameter of the opening 88 is larger than the diameter of the spherical weight 68 in order to provide room for the weight 68 to spin and rotate independently from the wire frame handle 85. The retaining piece 72 is secured to the wire frame member 85 and retains the spherical weight 68 within the opening 88. In one embodiment, the retaining piece 72, such as, for example, a flexible wire rod, is secured to the wire frame member 85 by wrapping opposing ends of the retaining piece 72 around the member 85 on opposing sides of the opening 88. However, other means for securing the weight 68 within the opening 88 are possible in other embodiments.

Figure 14:
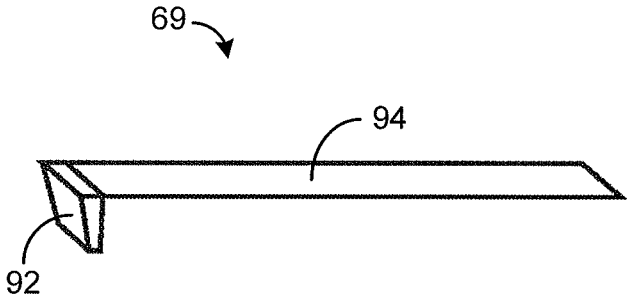
FIG. 14 depicts a perspective view of the locking device of FIG. 7.

FIG. 14 depicts a top perspective view of an exemplary embodiment of a locking device 69, such as is depicted by FIG. 7. In one embodiment, the locking device 69 comprises a flat protrusion 92 extending in a generally perpendicular direction from an end of a flexible mounting strip 94. An opposing end of the mounting strip 94 is coupled to the handle assembly 64 (FIG. 7) such that the protrusion 92 abuts the lower blade stop 83 when the blade assembly 62 (FIG. 7) is in the open position. When adjusting the position of the blade assembly 62 is desired, the mounting strip 94 may bend such that the protrusion 92 no longer abuts the lower blade stop 83 and the blade assembly 62 may rotate in the longitudinal plane of the VATO 60. When the blade assembly 62 is in the closed position, the protrusion 92 is inserted into the slot 75 (FIG. 7) in order to lock the blade assembly 62 in the closed position. The mounting strip 94 may bend in order to remove the protrusion 92 from the slot 75 and again adjust the position of the blade assembly 62, as may be desired.

Figure 15:
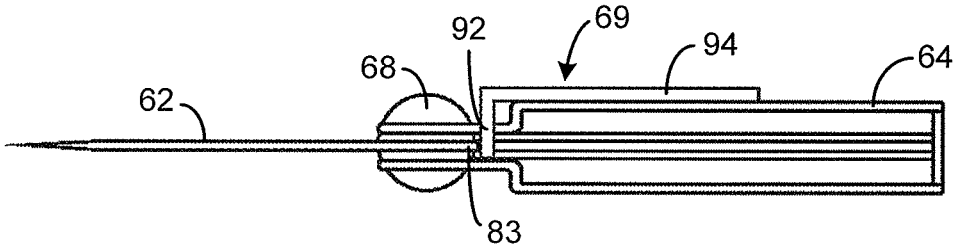
FIG. 15 depicts a bottom view of the VATO of FIG. 7 with the blade assembly in an open position.
Figure 16:
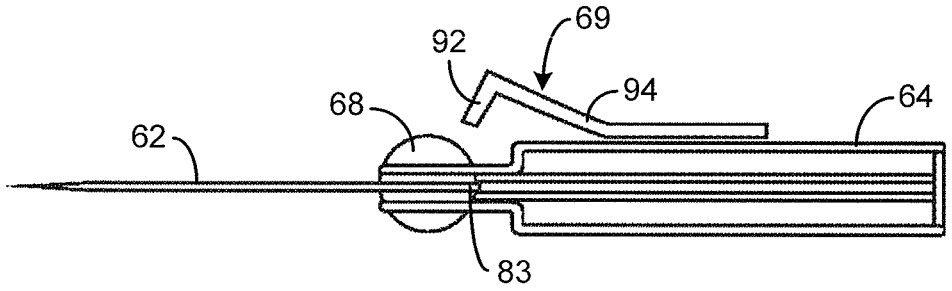
FIG. 16 depicts a bottom view of the VATO of FIG. 7 with the locking device bent away from the handle assembly.

FIGS. 15 and 16 depict bottom views of the VATO 60 of FIG. 7. FIG. 15 depicts a bottom view of the VATO 60 of FIG. 7 with the blade assembly 62 locked in the open position. As shown by FIG. 15, both the blade assembly 62 and the handle assembly 64 receive the spherical weight 68. The locking device 69 is mounted to the handle assembly 64 such that the protrusion 92 abuts the lower blade stop 83 thereby preventing rotation of the blade assembly 62 and locking the blade assembly 62 in the open position. When adjusting the position of the blade assembly 62 to the closed position is desired, the mounting strip 94 may be bent away from the handle assembly 64 such that the protrusion 92 no longer abuts the lower blade stop 83, as shown by FIG. 16. The blade assembly 62 may then be pivoted about the spherical weight 68 to the closed position and the protrusion 92 may be inserted into the slot 75 (FIG. 7) to lock the assembly 62 in the closed position, as set forth above.

Figure 17:
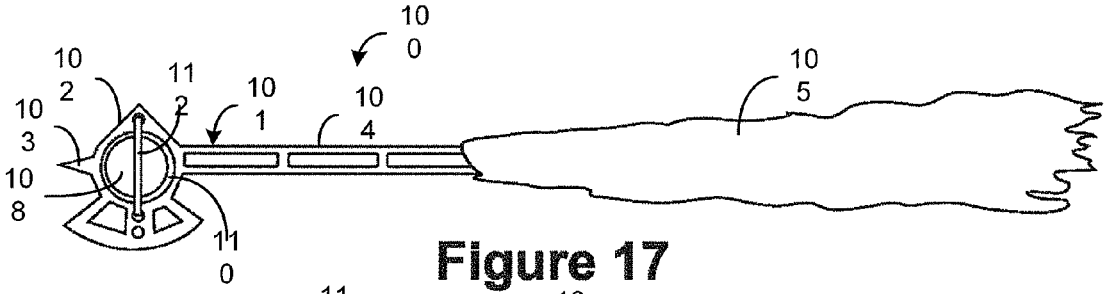
FIG. 17 depicts a side view of an exemplary VATO according to another aspect of the present disclosure.

FIG. 17 depicts an exemplary embodiment of a VATO 100 according to another aspect of the present disclosure. The VATO 100 comprises an axe frame assembly 101 having a blade 102 and a handle 104. In one embodiment, the blade 102 has one or more sharp points 103 located on a forward end of the blade 102 for piercing a target. The VATO 100 further comprises a stabilizing assembly 105 attached to a rear end of the handle 104, and a spherical weight 108 positioned within an opening 110 of the axe frame assembly 101. The spherical weight 108 is retained within the opening 110 via one or more retaining pieces 112, such as, for example, flexible wire rods. As set forth above with respect to the VATOs 10, 40 and 60, a majority of the weight of the VATO 100 is located in the spherical weight 108. Such weight distribution allows the VATO 100 to fly in a straight path based upon the trajectory of the spherical weight 108. The spherical weight 108 spins and rotates freely within the opening 110 in order to allow the axe frame assembly 101 and the stabilizing assembly 105 to independently align themselves with the trajectory of the spherical weight 108 while the VATO 100 is in flight. Accordingly, the sharp points 103 of the blade 102 remain in a forward position while the VATO 100 is in flight.

Figure 18:
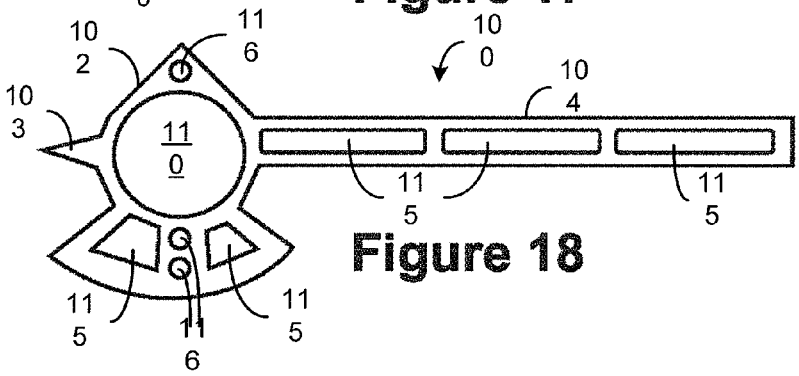
FIG. 18 depicts a side view of the axe frame assembly of FIG. 17.

FIG. 18 depicts the axe frame assembly 101 of FIG. 17. The axe frame assembly 101 comprises the blade 102, one or more sharp points 103, and the handle 104. The assembly 101 has the opening 110 for receiving the spherical weight 108 (FIG. 17). In one embodiment, the axe frame assembly 101 is formed from one solid piece of material, such as, for example, steel. However, the axe frame assembly 101 may comprise more than one piece and different materials in other embodiments. The assembly 101 of FIG. 18 has a plurality of openings 115 for reducing the overall weight of the assembly 101 such that the spherical weight 108 makes up a larger portion of the overall weight of the VATO 100. The assembly 101 also has a plurality of holes 116 for receiving the retaining pieces 112 (FIG. 17).

Figure 19:
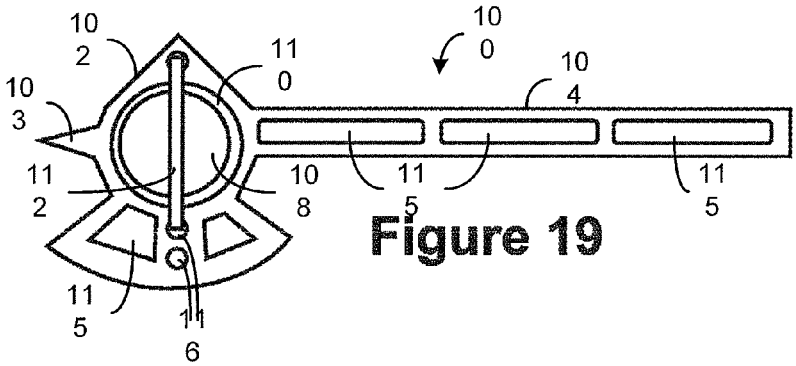
FIG. 19 depicts a side view of the VATO of FIG. 17 with the stabilizing assembly removed.

FIG. 19 depicts the spherical weight 108 of FIG. 17 secured within the opening 110 of the axe frame assembly 101. The spherical weight 108 is retained within the opening 110 via the retaining pieces 112. In one embodiment, the retaining pieces 112 are secured to the axe frame assembly 101 by inserting the pieces 112 into the holes 116 around the spherical weight 108. However, other methods for securing the retaining pieces 112 to the assembly 101 are possible in other embodiments. The axe frame assembly 101 may be used in the same way as a conventional axe or may be thrown such that the points 103 are always oriented towards the target.

Figure 20:
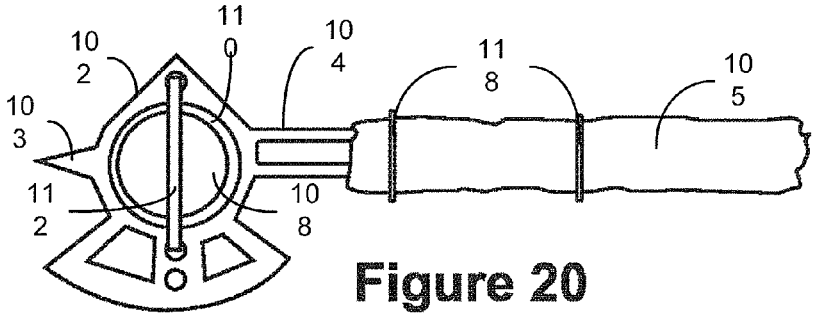
FIG. 20 depicts a side view of the VATO of FIG. 17 with the stabilizing assembly in a stowed position.

FIG. 20 depicts the VATO 100 of FIG. 17 with the stabilizing assembly 105 in a stowed position. In one embodiment, the stabilizing assembly 105 may be folded up around the handle 104 and used as a handle grip. In such embodiment, the stabilizing assembly 105 is held in position by one or more retaining clips 118. Thus, the retaining clips 118 retain the assembly 105 in the stowed position in order to facilitate use of the VATO 100 as a conventional axe. When throwing the VATO 100 at a target is desired, the retaining clips 118 are removed thereby freeing the stabilizing assembly 105. When the VATO 100 is thrown, the stabilizing assembly 105 produces aerodynamic drag causing the points 103 to remain oriented in a forward position with respect to the trajectory of the VATO 100, as set forth above. Accordingly, a VATO 100 which may be used in the same manner as a conventional axe or thrown without rotating end over end is provided.

Now, therefore, the following is claimed:

1. A velocity aligned throwable object (VATO), comprising:
   - a handle having a first end and a second end;
   - a blade extending from the first end of the handle;
   - a stabilizing assembly coupled to the second end of the handle; wherein the stabilizing assembly comprises one of cloth, other flexible material, collapsible fins, rudders, arrow fletchings or wings; and
   - a spherical weight positioned within a circular opening near the first end of the handle, wherein a wire forming the circular opening comprises at least two eyelets for receiving at least one retaining piece that is made of a flexible material that is looped through the two eyelets, wherein the spherical weight freely rotates when the VATO is thrown within the opening independently from the blade, the handle and the stabilizing assembly.

2. The VATO of claim 1, further comprising at least one retaining piece coupled to the VATO, wherein the retaining piece is configured to retain the spherical weight within the opening.

3. The VATO of claim 1, wherein the blade and the handle are formed from a single piece of metal.

4. The VATO of claim 1, wherein the blade is pivotally attached to the first end of the handle, and wherein the blade may be positioned within the handle when the blade is transitioned to a closed position.

5. The VATO of claim 4, further comprising a locking device configured to engage with the blade and prevent the blade from pivoting.

6. The VATO of claim 1, wherein the blade and the handle comprise an axe frame assembly.

7. A velocity aligned throwable object (VATO), comprising:
   - a handle assembly having a first end and a second end, the handle assembly further having a circular opening positioned near the first end of the handle assembly;
   - a blade extending from the first end of the handle assembly, the blade having a sharp point;
   - a stabilizing assembly extending from the second end of the handle assembly; wherein the stabilizing assembly comprises one of cloth, other flexible material, collapsible fins, rudders, arrow fletchings or wings; and
   - a spherical weight positioned within the opening, the spherical weight constituting a substantial portion of the overall weight of the VATO, wherein a wire forming the circular opening comprises at least two eyelets for receiving at least one retaining piece that is made of a flexible material that is looped through the two eyelets, wherein the spherical weight freely rotates within the opening independently from the other components of the VATO when the VATO is in a trajectory once the VATO is thrown.

8. The VATO of claim 7, wherein the stabilizing assembly comprises flexible fabric.

9. The VATO of claim 7, further comprising at least one retaining piece coupled to the VATO, wherein the retaining piece is configured to retain the spherical weight within the opening.

10. The VATO of claim 7, wherein the blade is pivotally attached to the first end of the handle assembly, and wherein the blade may be positioned within the handle assembly when the blade is transitioned to a closed position.

11. The VATO of claim 10, further comprising a locking device configured to engage with the blade and prevent the blade from pivoting.

12. The VATO of claim 1, wherein the handle, the opening, and the blade are formed from one solid piece of material.

13. The VATO of claim 6, wherein the handle and the opening are formed from a wire frame.

14. The VATO of claim 1, wherein the stabilizing assembly is made of a flexible material and rotates independently so that the stabilizing assembly produces aerodynamic drag.

15. The VATO of claim 9, wherein the stabilizing assembly aligns itself in a rearward position with respect to a trajectory of the VATO.

16. The VATO of claim 1, wherein the handle has the circular opening positioned near the first end and has a rectangular opening extending side to side therethrough positioned near the second end.

* * * * *